US008806760B2

(12) United States Patent
Moons

(10) Patent No.: US 8,806,760 B2
(45) Date of Patent: Aug. 19, 2014

(54) HAIRDRESSER'S TOOL

(75) Inventor: Mathias Theodorus Maria Moons, Son en Breugel (NL)

(73) Assignee: Gijsbert Van Dusschoten, Amersfoort (NL)

( * ) Notice: Subject to any disclaimer, the term of this patent is extended or adjusted under 35 U.S.C. 154(b) by 899 days.

(21) Appl. No.: 12/663,064

(22) PCT Filed: Jun. 6, 2008

(86) PCT No.: PCT/NL2008/050356

§ 371 (c)(1),
(2), (4) Date: Apr. 9, 2010

(87) PCT Pub. No.: WO2008/150168

PCT Pub. Date: Dec. 11, 2008

(65) Prior Publication Data

US 2010/0218387 A1 Sep. 2, 2010

(30) Foreign Application Priority Data

Jun. 6, 2007 (NL) ..... 1033944

(51) Int. Cl.
*B26B 3/06* (2006.01)

(52) U.S. Cl.
USPC ..... 30/155; 30/156; 30/53; 30/321

(58) Field of Classification Search
USPC ..... 30/53, 321, 57, 54, 79, 157, 156, 75, 30/346.51, 30, 58, 155; 132/213, 149
See application file for complete search history.

(56) References Cited

U.S. PATENT DOCUMENTS

| | | | | |
|---|---|---|---|---|
| 1,844,800 | A * | 2/1932 | Schuetz | 30/53 |
| 2,133,087 | A * | 10/1938 | Ericsson | 30/320 |
| 2,315,297 | A | 3/1943 | Tischler | |
| 2,543,096 | A | 2/1951 | Dierdorf | |
| 2,602,992 | A * | 7/1952 | Elliott | 30/69 |
| 3,255,523 | A | 6/1966 | Robertson et al. | |
| 4,100,677 | A * | 7/1978 | Jeff | 30/321 |
| 5,400,512 | A * | 3/1995 | Brush | 30/321 |
| 6,092,288 | A * | 7/2000 | Adachi | 30/53 |
| 6,134,788 | A * | 10/2000 | Chen et al. | 30/125 |
| 6,249,973 | B1 * | 6/2001 | Hirano | 30/30 |
| 6,460,254 | B1 * | 10/2002 | Mori et al. | 30/286 |

(Continued)

FOREIGN PATENT DOCUMENTS

| | | |
|---|---|---|
| EP | 0 924 035 A | 6/1999 |
| EP | 0 943 403 A1 | 9/1999 |
| EP | 1 216 799 A | 6/2002 |
| GB | 2 148 174 A | 5/1985 |

OTHER PUBLICATIONS

International Search Report for PCT/NL2008/050356, dated Dec. 3, 2008.

*Primary Examiner* — Omar Flores Sanchez
(74) *Attorney, Agent, or Firm* — Leydig, Voit & Mayer, Ltd.

(57) ABSTRACT

A multifunctional hairdresser's tool, with which, in combination with an assortment of replaceable blades, different cutting techniques can be carried out. The tool comprises a holder (1) with a handle (3) in which a blade is held by a coupling system. The blade can be fixed in various positions. The assortment of replaceable blades varies from an adapted design of a known type of blade to different completely new types of blades.

21 Claims, 14 Drawing Sheets

(56) References Cited

U.S. PATENT DOCUMENTS

| | | | | |
|---|---|---|---|---|
| 6,598,301 | B2 * | 7/2003 | McCool et al. | 30/321 |
| 6,675,485 | B1 * | 1/2004 | Shih et al. | 30/321 |
| 6,807,738 | B1 * | 10/2004 | Shih et al. | 30/321 |
| 7,146,738 | B2 * | 12/2006 | Yu | 30/358 |
| 2004/0181944 | A1 * | 9/2004 | Clark | 30/53 |
| 2006/0085986 | A1 * | 4/2006 | Lee | 30/53 |
| 2007/0151109 | A1 * | 7/2007 | Okazaki | 30/53 |

* cited by examiner

HAIRDRESSER'S TOOL

FIELD OF THE INVENTION

The invention relates to a hairdresser's tool, more in particular a multifunctional hairdresser's tool.

BACKGROUND

Cutting is the basic technique of hairdressers. Instead of cutting, slicing is more advanced technique with which a hairdresser can distinguish himself from other hairdressers. With this technique, a higher-quality result can be achieved in the customer's hair style. A hairdresser who has a pair of quality scissors at his disposal can cut as well as slice with these scissors. Hairdressers with lesser, usually cheaper tools cannot slice with them, however.

A known hairdresser's tool with which slicing can be practiced is provided with a holder designed as a handle and with at least one exchangeable cutting element which is detachably connected to this holder. Such a hairdresser's tool is known from European patent publication EP 0 943 403 A1. The holder of this hairdresser's tool is only arranged to be able to cooperate with a single type of cutting element and can couple this cutting element to the holder only in a single position. For hairdressers, it is important that they can optimize their posture during work. Not only does this allow them to use more creativity in their hair styles, but also RSI complaints, not unknown in hairdressing either, can be prevented. Due to the known fixed position of the exchangeable cutting element, changing the posture during work when doing someone's hair is insufficiently promoted. For the creativity, it is further very important that not only a cutting element which has become blunt can be replaced by a new one of the same type, but also that different cutting elements become available.

SUMMARY OF THE INVENTION

Accordingly, it is an object of the present invention to eliminate or improve at least one of the drawbacks of the prior art. It is also an object of the present invention to provide alternative constructions which are easier to manufacture and use and can, in addition, be made relatively advantageously. Alternatively, it is an object of the invention to provide the public with an at least useful option.

To this end, the invention provides a hairdresser's tool provided with a holder with handle and with at least one exchangeable cutting element which is detachably coupled to the holder, wherein the holder is equipped with first coupling means and the cutting element has second coupling means, which first and second coupling means are arranged to hold the cutting element in at least two different positions with respect to the holder as desired, wherein the first and second coupling means are designed as angularly settable coupling means for optimizing the angular position of the cutting element with respect to the holder. Thus, a holder designed as a handle is obtained in which a cutting element can be placed in a simple and safe manner and in which this cutting element can be fixed in different positions. This allows achieving an ergonomic position during work of upper body, arm, hand and fingers according to the hairdresser's own judgment. Existing hairdresser's tools (including scissors) have only one position option with respect to the hairdresser's hand and cannot be set. As a result, the hairdresser sometimes needs to assume one or more awkward positions during work to make controlled cutting or slicing possible. Due to the setting possibility, working with a hairdresser's tool according to the invention is considerably simplified and better controllable. In addition, the holder can be ergonomically optimized. Because the cutting element in the holder can be placed on many different positions, the holder does not need to be moved in the hand. As a result, the holder can be designed optimally for the best hand position.

This also enables using different cutting element types in the same holder. Both moving the cutting element downwards and moving it upwards can be brought about by holding the same holder in the hand in the same manner and only placing the cutting element in the holder so that it is turned round. Also, more predetermined positions of the cutting element in the holder can be provided.

The invention further provides a cutting element of an exchangeable type for use with the hairdresser's tool according to the invention. By providing an assortment of different exchangeable and recyclable cutting elements, different slicing techniques can be carried out as desired. The choice of cutting elements enables hairdressers to achieve a professional result without high investment costs.

A special embodiment of the cutting element can be provided with two fixedly arranged scissor jaw halves converging towards each other and wherein a cutting blade is provided on only a single one of the two scissor jaw halves. This cutting element is an alternative to the traditional slicing with a slightly opened scissor jaw. With this cutting element, the hairdresser no longer needs to have a pair of quality scissors to still give the haircut a finishing touch with a slicing (as if he had a pair of top-quality scissors). He takes the special scissor cutting element and achieves the same result at a much lower investment. By designing the housing to be shaped like a slightly opened scissor jaw in which a cutting face is provided on one of the scissor jaw sides, the function of a slicing pair of scissors is created. The hair is not cut but sliced. By providing a cutting blade only on one jaw side, the hair can be cut in a very specific manner. By moving the cutting element through the hair, a lock of hair is selected. By then moving the cutting element in a combination of vertical and horizontal direction, the lock of hair can be cut off in one stroke while still a difference in slicing length of the hair is achieved. As a result, the hair becomes less 'cut' or 'chopped' but a nice, smooth haircut is obtained.

The invention also provides a cutting element for use with the hairdresser's tool with exchangeable cutting elements or in a hairdresser's tool in which the cutting element is integrated so not to be exchangeable, wherein a cutting edge is provided which has a part of a longer cutting edge extending at least between two teeth. This is particularly a cutting element or hairdresser's tool where the cutting blade has a circular cutting edge, of which only a minor circumferential part extends between these two teeth, as is defined in more detail in the appended claims. By, for instance, integrating a round blade in a plastic housing, a compact cutting element is created with a relatively long cutting face. This cutting element may be offered as a recyclable unit. The relatively long cutting face is then not in the way during working with the tool, in that the fresh supply of cutting face is not in, or near, the operative position (i.e. not near the cutting face in use). Should the cutting face have become too blunt, than a fresh sharp cutting face can simply be brought into operative position by turning a central knob one or more click positions. To ensure that always a sharp cutting face is turned into operative position, and not (accidentally) an already used cutting face, a stop is provided so that the knob can only be turned in one direction. Also, for the same reason, the knob may be turned round (360°) only once. Thanks to such a construction, the hairdresser knows with certainty that, after turning the knob, he has a sharp cutting face at his disposal. With this round blade element, different designs can be made by designing a plastic housing in different functional designs.

BREIF DESCRIPTION OF THE DRAWING

In the following, the invention will be explained in more detail with reference to the Figures in the appended drawing, in which.

DETAILED DESCRIPTION OF THE DRAWINGS

Figure 1:
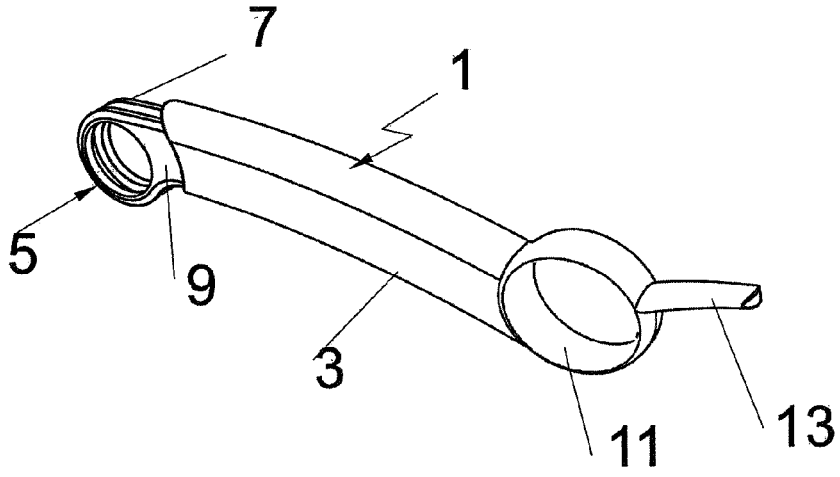
FIG. 1 is a view in perspective of a holder according to the invention, in closed condition and without a cutting tool being received therein.
Figure 2:
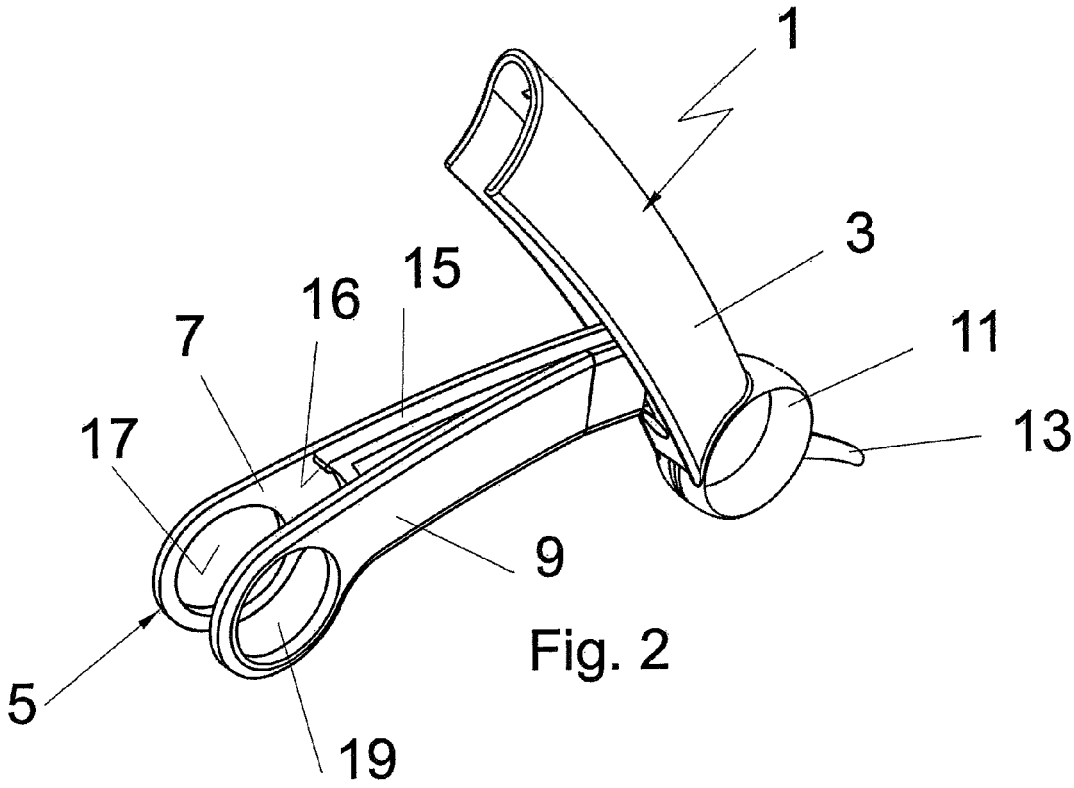
FIG. 2 is a view in perspective, from another point of view, of the holder of FIG. 1 shown in opened position.
Figure 3:
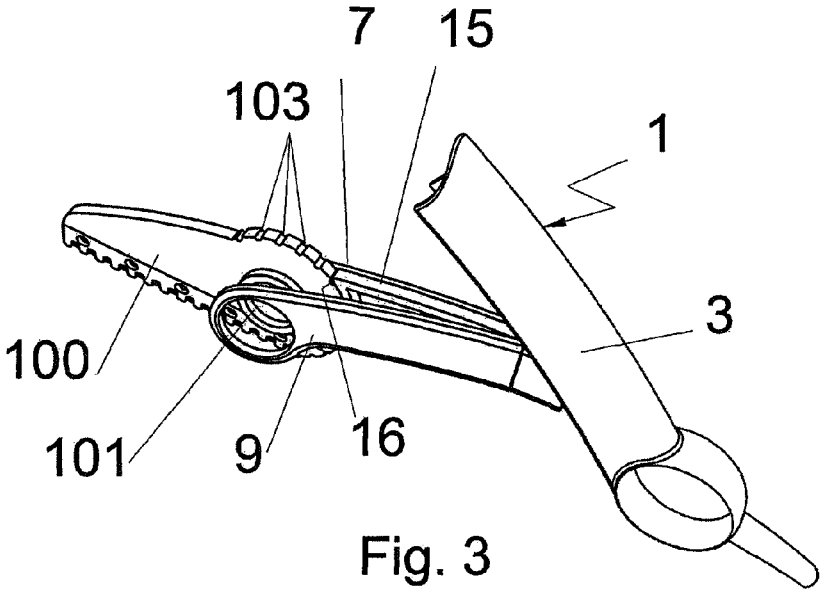
FIG. 3 shows the opened holder with a cutting element according to a first embodiment.

FIG. 1 shows a holder 1, which is substantially formed by a handle 3. On an end, the handle 3 is provided with a first coupling means 5. The first coupling means 5 has a first arm part 7 and a second arm part 9. The handle 3 in the embodiment shown in provided with an integrally formed eye 11 with which the hairdresser can optionally balance the holder around his ring finger or pink to thus pivot it into and out of an operative position. An extension piece 13 may further be helpful for this. FIGS. 2 and 3 show how the holder 1 can be opened to couple an exchangeable cutting element 100 (FIG. 3) thereto. The first and second arm parts 7,9 are pivotally fixed to the handle 3 and are pivotable outwards about a point of rotation located near the integrally formed eye 11. FIG. 2 further shows that the first arm part 7 is provided with a central part 15, which may optionally form an integral part of the first arm part 7. On the free end of the central part 15, a cam 16 is provided whose purpose will be explained in more detail hereinbelow. The second arm part 19 is additionally pivotable about an axis perpendicular to the axis about which the two arm parts 7,9 with the handle 3 are pivotable. This additional pivotability allows placing a cutting element (like 100 in FIG. 3) between the first arm part 7 and the second arm part 9. The additional pivotability of the second arm part 9 can be obtained with a traditional hinge construction which may be included in the central part 15, but the second arm part 9 may also be designed so as to be flexible in its entirety so that it is sufficiently elastic at its free end to allow it to be moved outwards. Such constructive options are known to a skilled person and do not need to be explained here in more detail. The same holds for the hinge connection between the handle 3 and the arm parts 7,9 of the coupling element 5. It can further be seen that the first arm part 7 is provided with a first opening 17 and the second arm part with a second opening 19. The first and second openings 17 and 19 may be designed to be equally large, as shown, but it is also possible to design them to be different in size or to provide them with other shapes than circular shapes.

FIG. 3 shows how a cutting element 100 can be fixed between the first and second arm parts 7 and 9. The cutting element 100 is then provided with a circular protrusion 101 which can be received in the second opening 19. A similar circular protrusion is also provided on the non-visible side of the cutting element 100 and serves for reception in the first opening 17. Further, the cutting element 100 has a number of notches 103 along a circular contour, which is concentric with the circular protrusions (like 101). The notches 103 cooperate with the cam 16 on the central part 15 to be able to lock the cutting element 100 in different angular positions with respect to the holder 1. In the embodiment shown, the cam 16 is a rigid element which is formed integrally with the central part 15. Here, the holder 1 will need to be opened each time to bring the cutting element into a different angular position. It is also conceivable that the cam 16 is designed as a movable element, such as a ball, which is moved outwards due to spring pressure. With such an alternative design, the possibility can be created that the cutting element 100 is still adjustable with a shut holder by moving the cutting element against the spring pressure of the ball to a different notch 103. In a still further derived form of the coupling means between holder and cutting element, a possibility is a surface set at a particular angle to the central part as an alternative to the cam 16. Instead of the notches 103, the cutting element may also be provided with a polygonal contour, which is in turn concentric with respect to the circular protrusion 101. Further, it is of course also possible to design one of the first and second openings 17, 19, or both, so as to have a polygonal shape and to replace the circular protrusion 101 by a polygonal protrusion cooperating therewith. It would be getting too far off the subject to discuss herein all possibilities of angularly variable coupling means available to a skilled person and the examples given are only given by way of illustration of this abundance of possibilities. The cutting element 100 is of a type which is also referred to as a slicer blade and that is already current in hairdressing for carrying out the slicer technique when hairdressing. Nevertheless, the cutting element 100 described is an exchangeable variant which is particularly suitable for cooperation with the holder described herein. Further, compared to the known slicer blades, an ergonomic advantage is achieved in that the cutting edge is angularly settable with respect to the holder 1.

Figure 4:
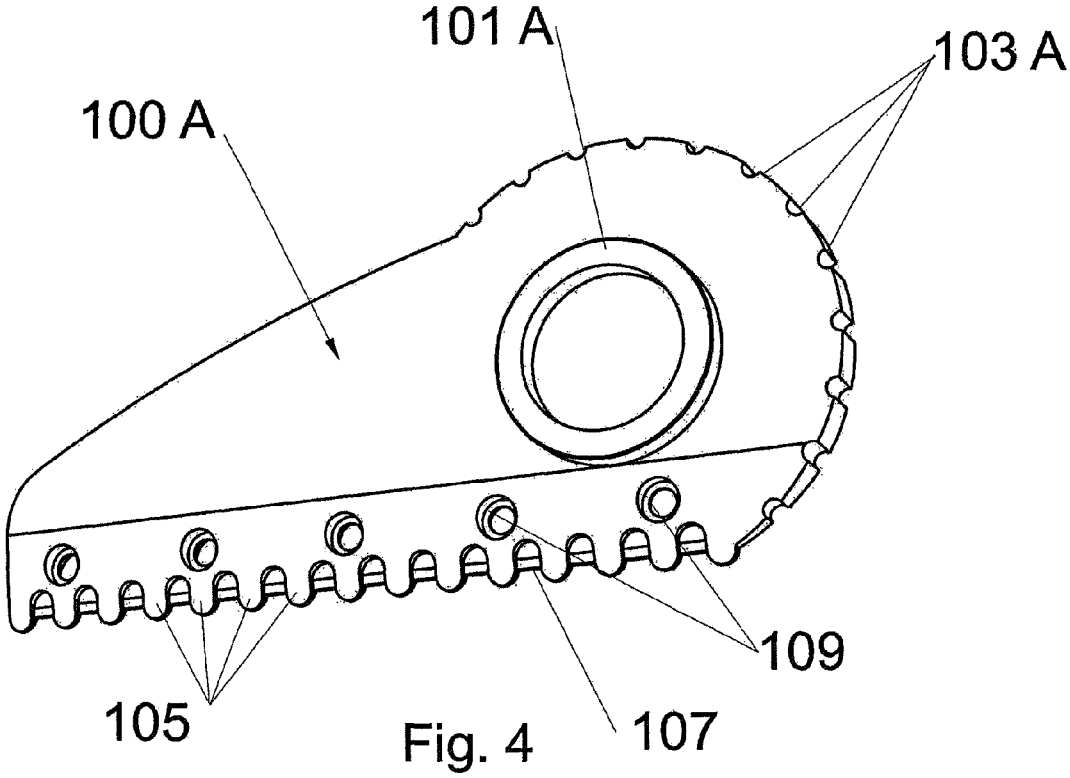
FIG. 4 shows a cutting means according to the first embodiment.

FIG. 4 shows a slightly modified form of the slicer blade 100A, which is provided with a smaller number of notches 103A. The slicer blade 100A also has an integrally formed circular protrusion 101A. It can be seen clearly in FIG. 4 that, on the cutting edge of the cutting element 100A, teeth 105 are integrally formed while a blade 107 is provided therein so as to be slightly recessed with respect to the teeth 105. The fastening of the blade 107 can be designed with rivets 109 or different fastening means. In a particularly advantageous manufacturing technique, during the injection molding process, the blade is laid in the mold and plastic is injected around it. This technique is called insert-molding. The positions otherwise taken by rivets are here openings in the plastic blade holder which are created by pins in the mold which keep the blade in position during injection molding. Also, invisible holes may be provided in the blade part which ensure that the plastic can adhere better to the blade surface. This technique is known to a skilled person and no further explanation is needed.

Figure 5:
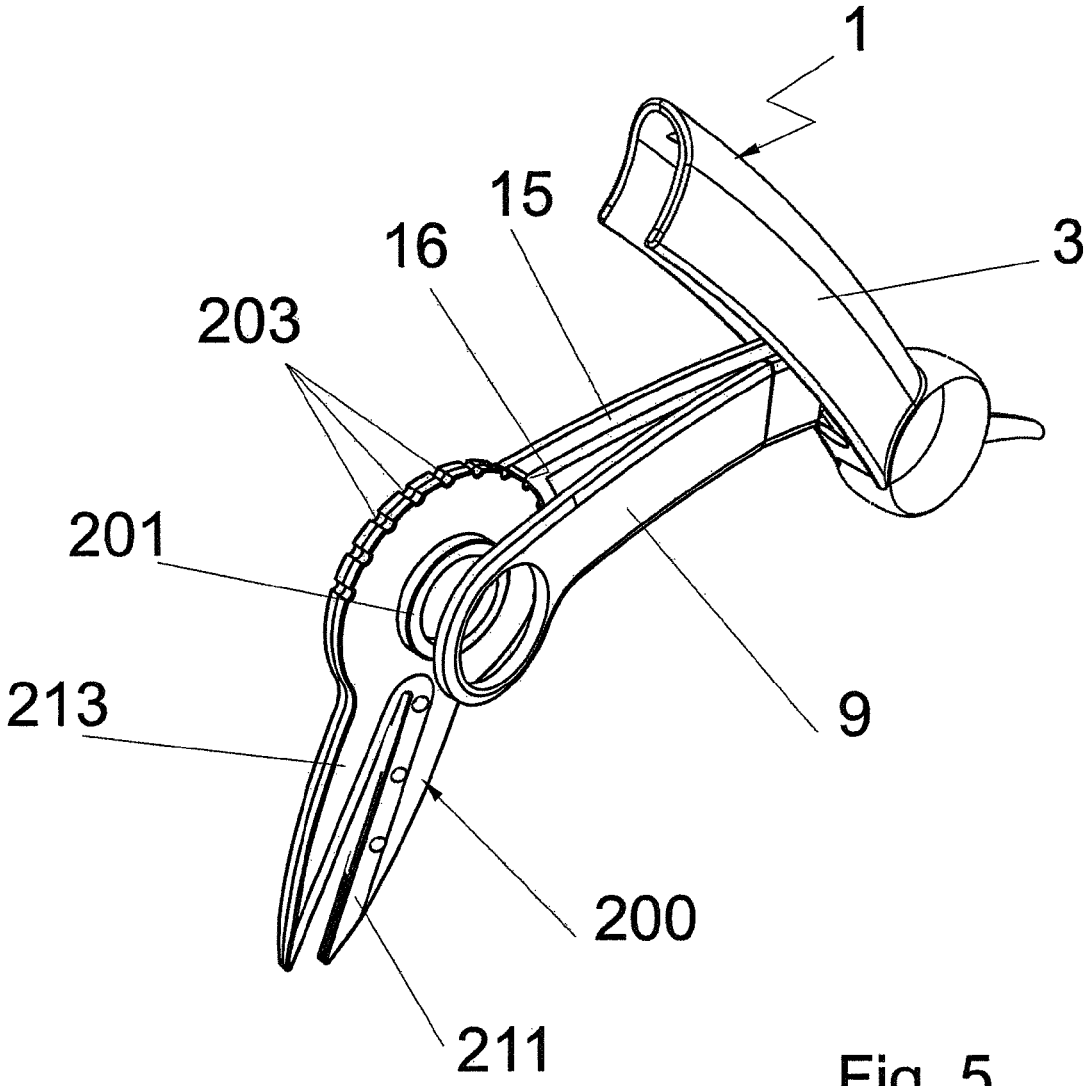
FIG. 5 shows the not yet closed holder with a cutting element according to a second embodiment.
Figure 6A:
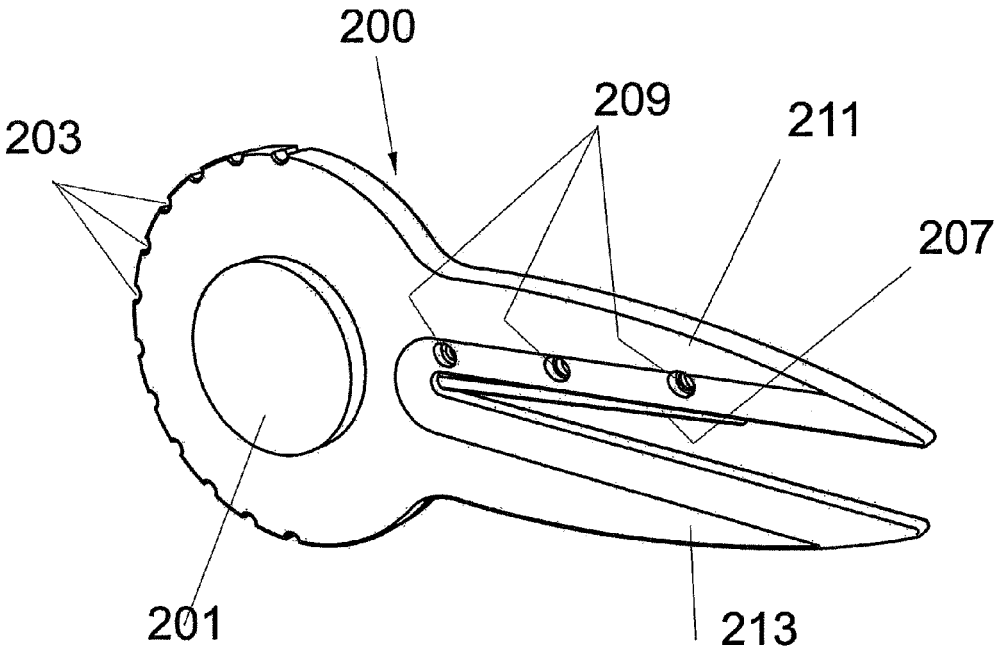
FIGS. 6A and 6B show a slightly modified variant of the cutting element according to the second embodiment, shown from two opposite sides.
Figure 6B:
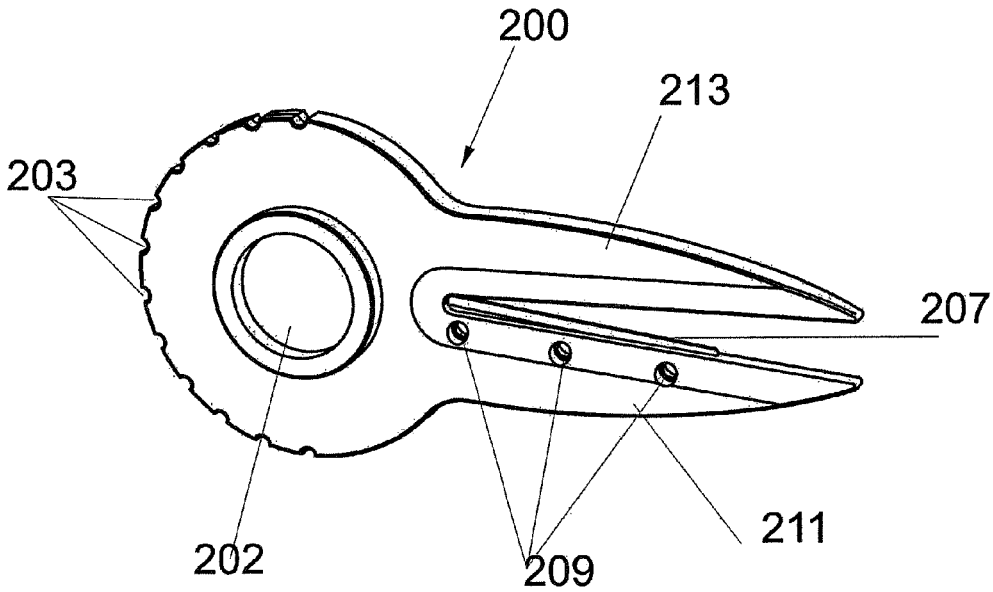

FIGS. 5, 6A and 6B show a different form of slicer blade 200. The second embodiment of the cutting element 200 can be used as an alternative to slicing, as this is sometimes carried out in practice with a slightly opened scissor jaw. The coupling of the second variant of the cutting element 200 with the holder 1 is the same as that of the first variant of the cutting element 100. The corresponding reference numerals are a full hundred higher in FIGS. 5, 6A and 6B than in FIGS. 3 and 4. For a description of the cooperation of the cutting element 200 with the holder 1, reference is therefore made to the description of FIG. 3. FIGS. 6A and 6B show how the special scissor blade 200 forms, as it were, a scissor jaw between diverging first and second jaw halves 211 and 213. Of these jaw halves, only the first jaw half 211 is provided with a blade 207 which can again be fastened by means of insert-molding or with rivets 209. FIGS. 7-18 show some very advantageous cutting elements in detail.

Figure 7:
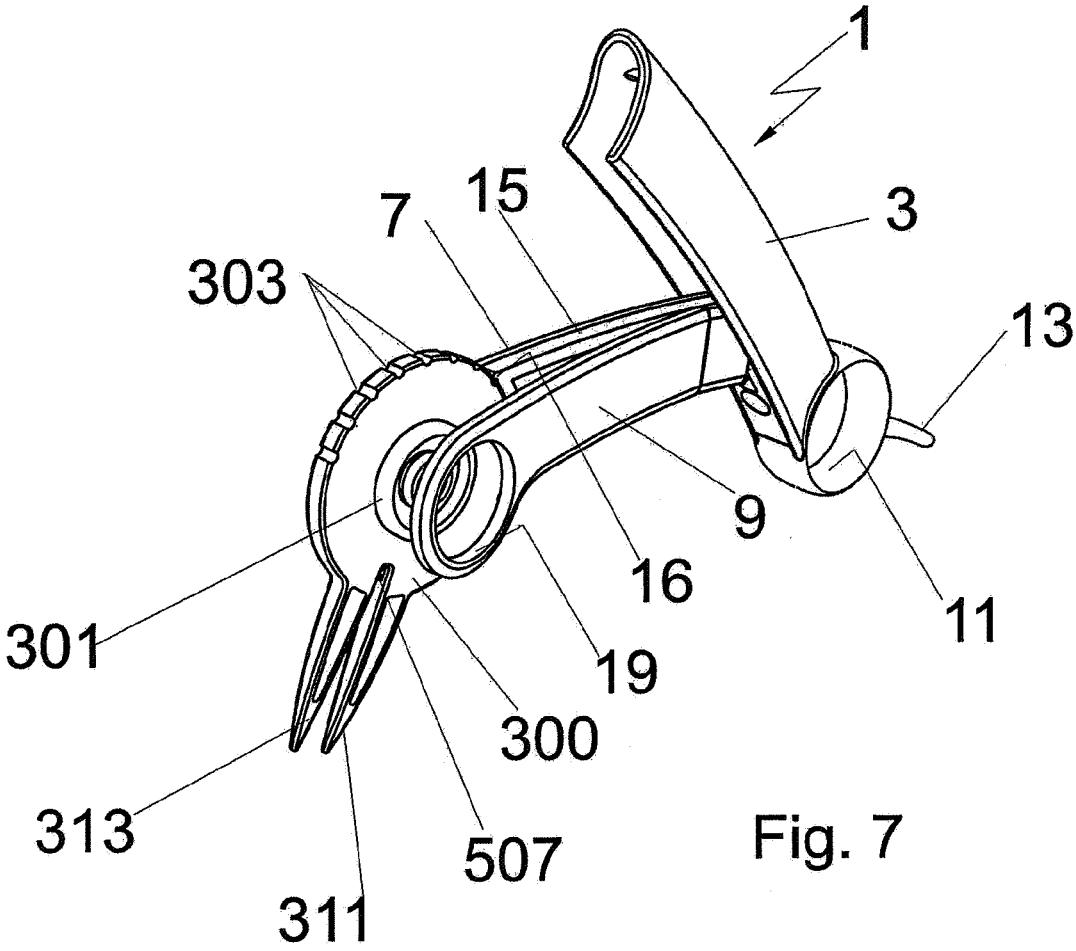
FIG. 7 shows an again not yet closed holder with a cutting element according to a third embodiment.

The cutting element 300 in FIG. 7 is an interesting variant of the scissor jaw blade 200 of FIGS. 5, 6A and 6B.

This third embodiment of the cutting element 300 differs in the placement of the cutting edge which makes this slicer tool particularly suitable for precision work and finishing hair styles. Here, again, the corresponding reference numerals are chosen so as to be a full two hundred higher than those according to FIG. 3, to which reference is again made for a description of the cooperation between the holder 1 and the cutting element 300.

Figure 8:
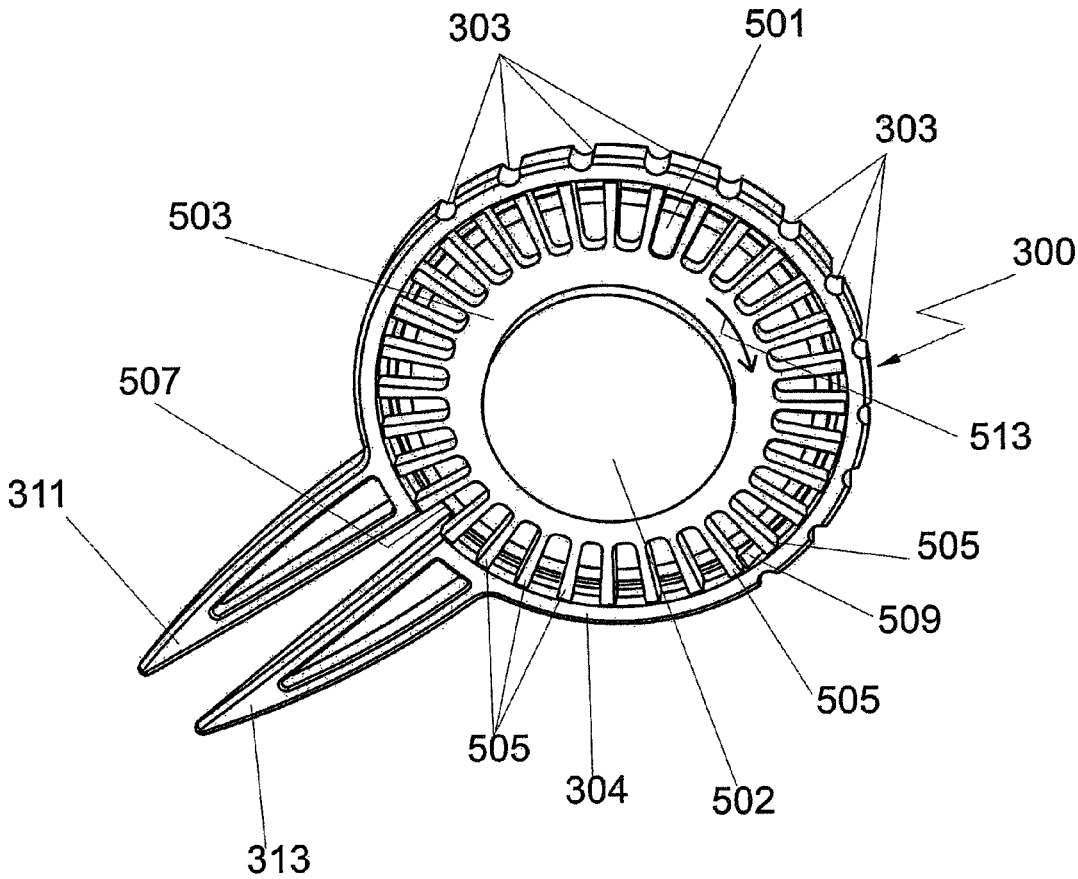
FIG. 8 shows the cutting element according to the third embodiment, from a different side than shown in FIG. 7.
Figure 9:
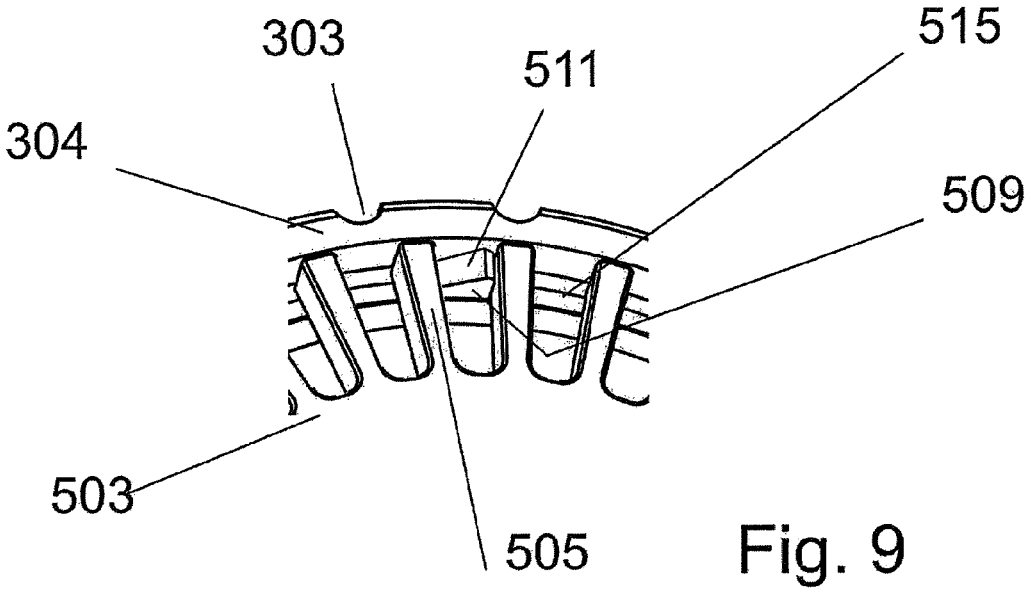
FIG. 9 shows a detail of the cutting element of FIG. 8.
Figure 10:
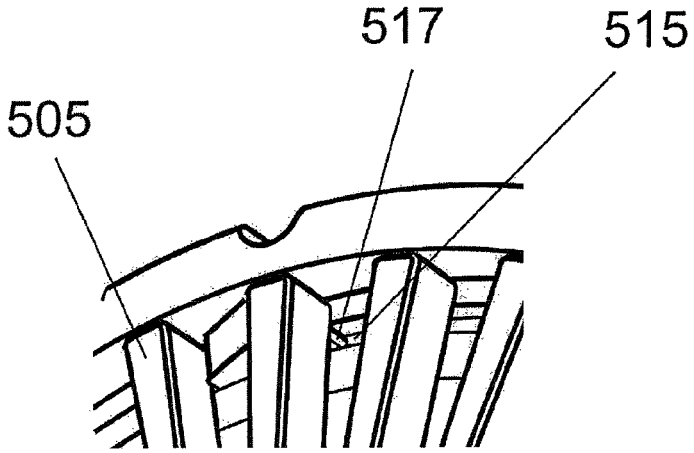
FIG. 10 shows another detail of the cutting element of FIG. 8.
Figure 11:
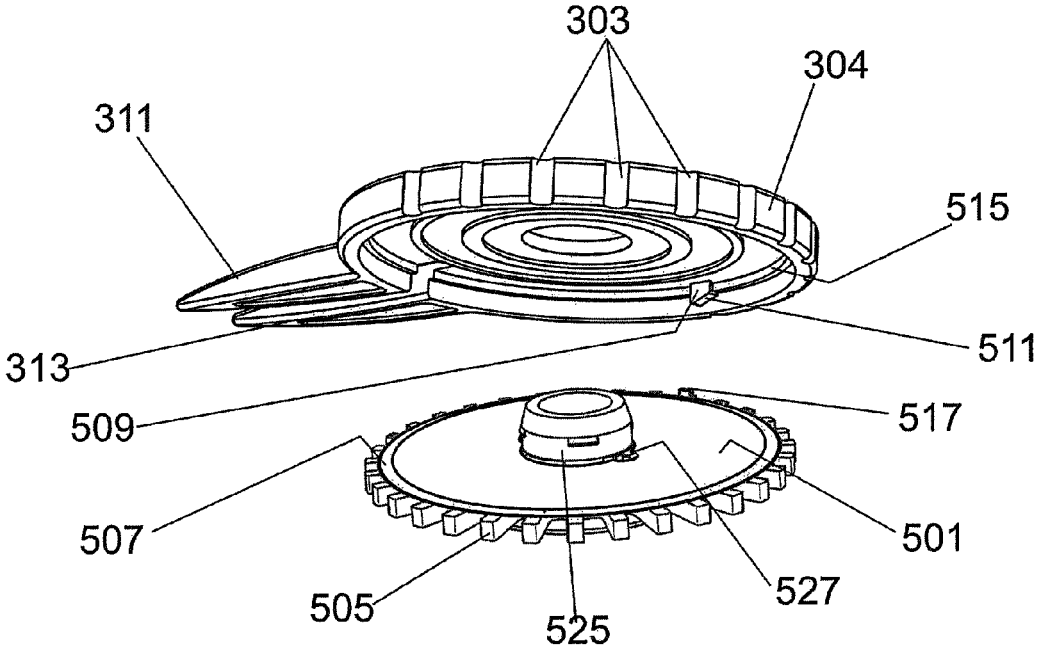
FIG. 11 is an exploded view of the cutting element according to the third embodiment.
Figure 12:
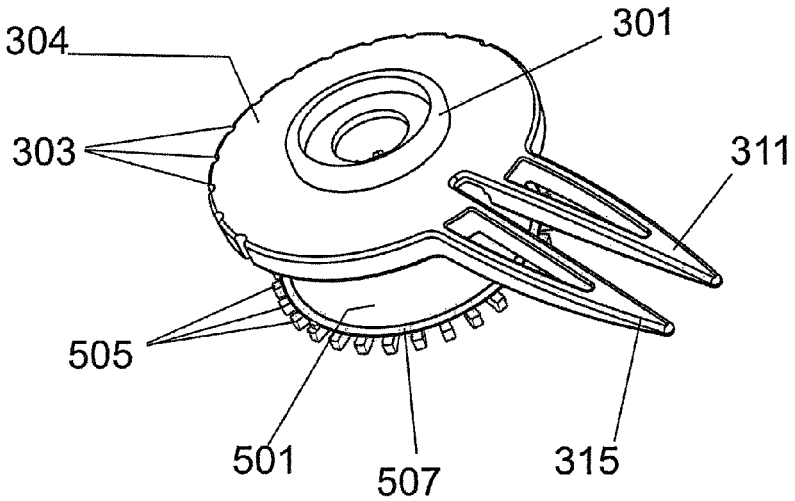
FIG. 12 is an exploded view of the cutting element according to FIG. 11 from another point of view.

FIG. 8 shows the third cutting element according to FIG. 7 in more detail and viewed from an opposite side. Here, the cutting element 300 is designed in multiple parts. A first and second scissor jaw half 311 and 313 are located on a first part 304. In a recess of the first part 304, a circular blade 501 is received which has a round cutting edge 507. The round cutting edge 507 is accessible over only a very limited part and that in the convergence point of the converging first and second scissor jaw halves 311 and 313. The blade 501 is kept in place by a blade holder 503. The blade holder 503 has a plurality of resilient arms 505 along its circumference. Further, the blade holder 503 is provided with a circular protrusion 502, which can be received in one of the openings 17 or 19 of the holder 1.

In further reference to FIGS. 9-13, it will now be described how the blade holder 502 of FIG. 8 enables a refreshment of the cutting edge.

FIG. 8 only just shows a cam 509 which has a fixed place on the first part 304 of the cutting element 300. This cam 509 is adapted to the distance between two successive radial resilient arms 505 and has a surface 511 obliquely rising in one tangential circumferential direction. As a result, on the one hand, a stop is obtained of the position of rotation of the blade holder 503 with respect to the first part 304 and the scissor jaw halves 311 and 313 of the cutting element 300. On the other hand, the surface 511 rising obliquely allows the resilient radial arms 505 to pass the cam 509, at least in one direction of rotation, according to arrow 513 (see FIG. 8). This makes it possible to always turn up a fresh cutting edge between the scissor jaw halves 311 and 313, while the limitation to one direction of rotation ensures that an already used part of the round cutting edge 507 is not turned up. Of course, this limitation on the direction of rotation is only effective as long as the blade 501 has not made a complete rotation of 360 degrees. So, it is desirable to also have some control of the total rotation of the blade 501. To this end, in the first part 304, a round groove 515 is provided in which a finger 517 on one of the resilient arms 505 is movably received. After a virtually complete rotation of the blade holder 503 in the first part 304, this finger will hit the cam 509 and prevent a further rotation. This can best be seen in FIGS. 10 and 11.

Figure 13:
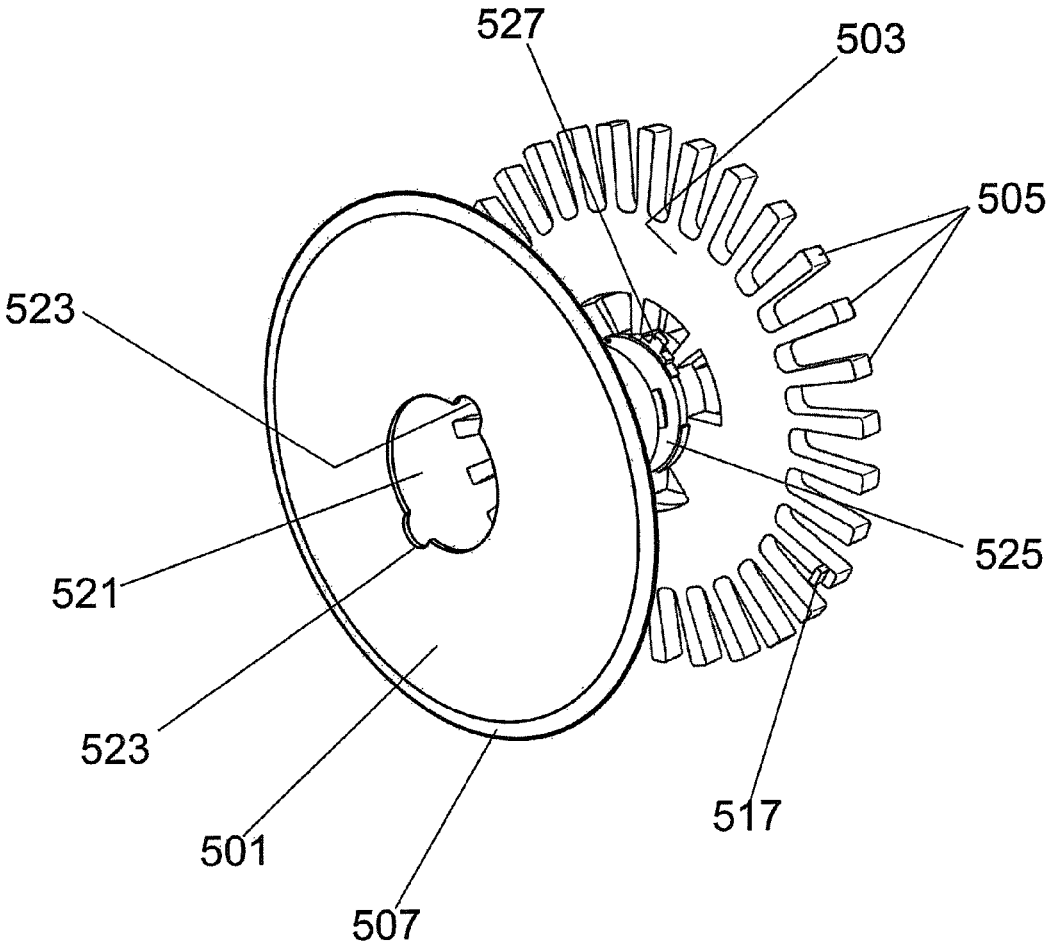
FIG. 13 shows an exchangeable blade with blade holder, which can be used with the cutting element according to the third embodiment and with a cutting element according to a fourth embodiment.

Further, FIG. 13 shows that the circular blade 501 has a central hole 521, which is provided with at least one recess 523 at the circumference, and in the embodiment shown with two recesses 523. This recess 523 cooperates with a cam 527 provided on a hub 525 of the blade holder 503. As a result, the circular blade 501 is not rotationally fixed to the blade holder 503 and can thus only be rotated together with the blade holder 503. The rotation of the blade holder 503 and consequently the blade 501 can take place by rotating the radial arms 505 with respect to the first part 304 of the cutting element with the thumb or index finger. It is also possible to provide means engaging the hub 525, as will be described in the following.

FIGS. 14-18 show a fourth embodiment of the cutting element 400, which also uses the circular blade 501 as it is described for the third embodiment. This is also a slicer cutting element of which the length of the cutting face is intentionally chosen so as to be limited, just like with the third embodiment. This enables working more accurately and with a higher speed, which is also good for the creative expression of a hairdresser. Working with this type of tool also contributes to a show effect, which is not unimportant in a hairdressing salon.

Figure 15A:
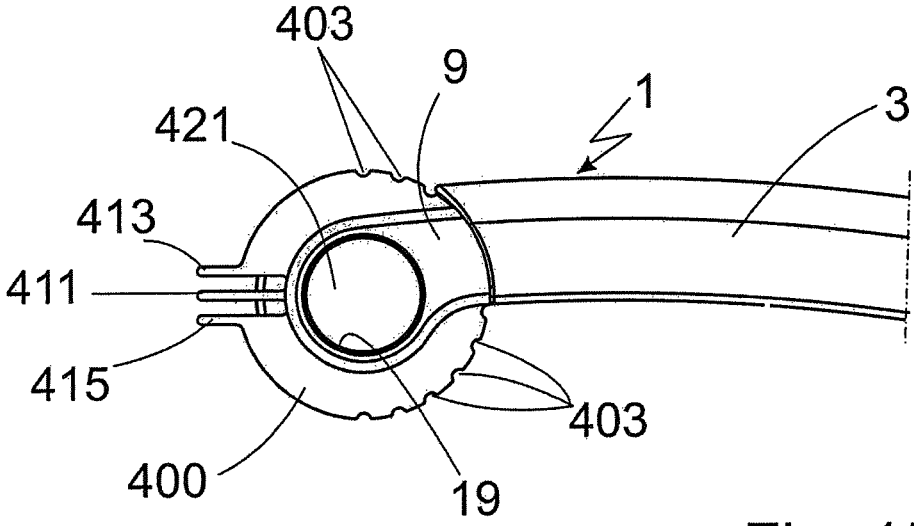
FIGS. 15A and 15B show the cutting element according to the fourth embodiment coupled to the closed holder in two different angular positions with respect to the handle of the holder.
Figure 15B:
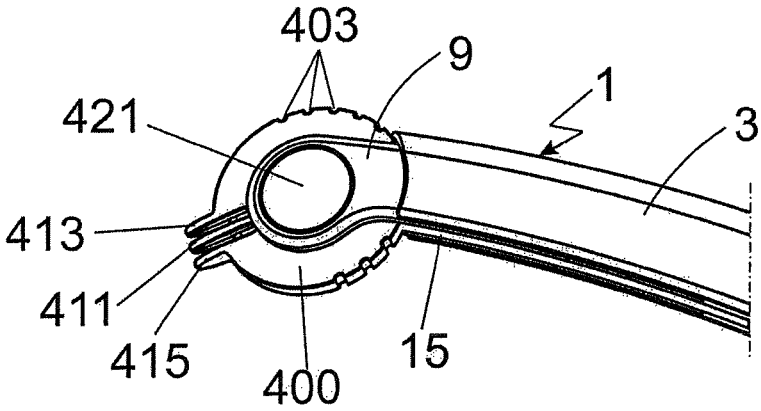
Figure 16:
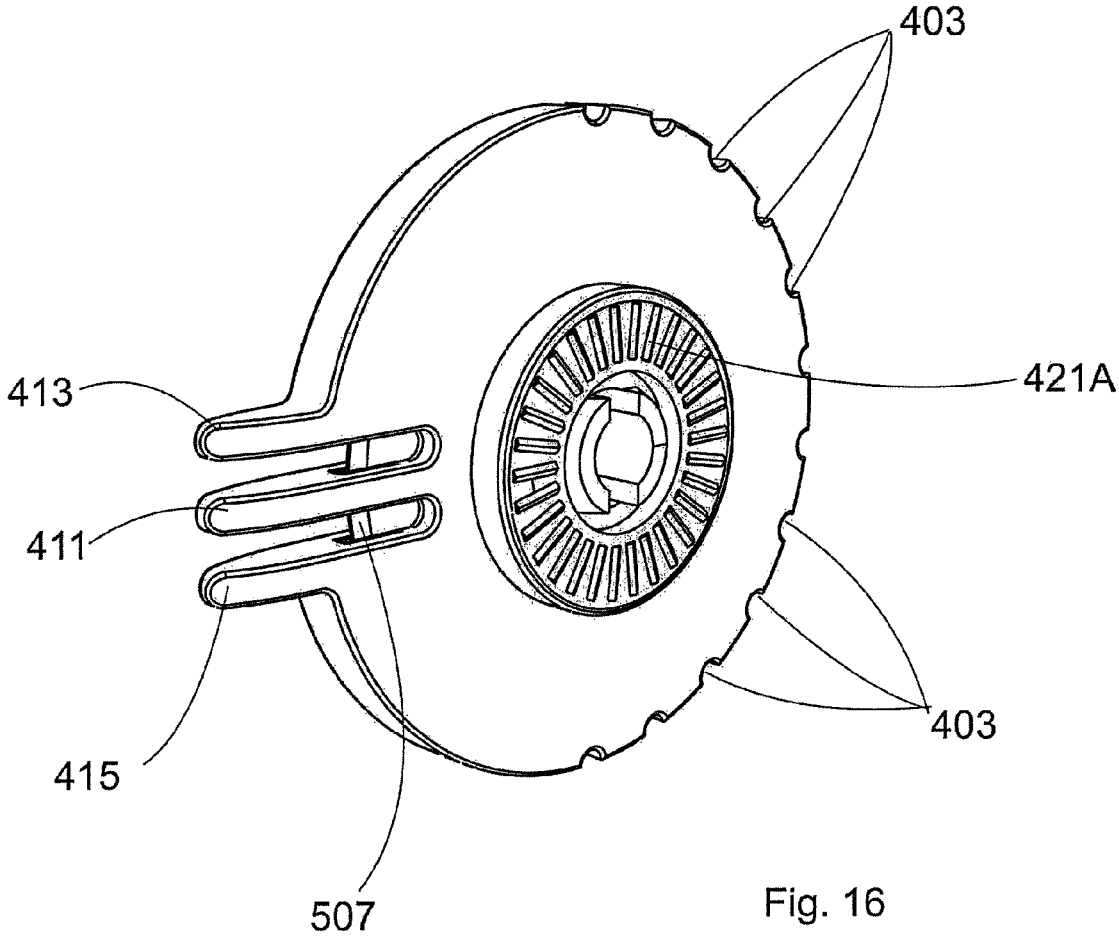
FIG. 16 shows the cutting element according to the fourth embodiment, with a serrated knob to be operated with a thumb for turning up a new part of the cutting edge.

FIGS. 15A and 15B show the holder 1 in shut, closed condition with the cutting element 400 in two different angular positions as predetermined by the notches 403. Between three short teeth 411, 412 and 413, two cutting face parts are released of the round cutting edge 507.

Figure 14:
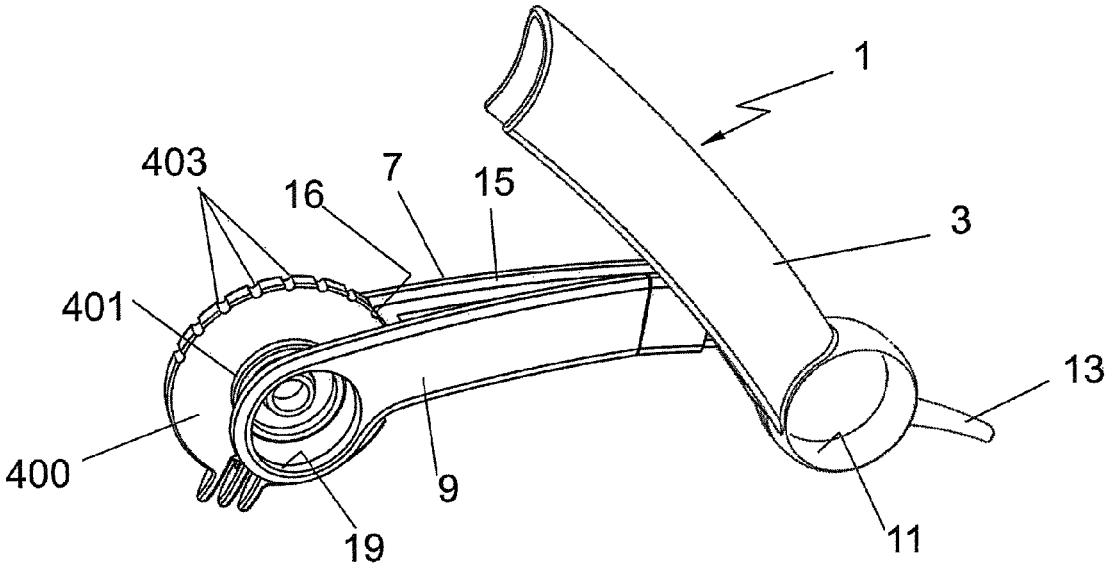
FIG. 14 shows the holder prior to the closing thereof with a cutting element according to a fourth embodiment in a position to be coupled.

In FIGS. 14-18, again the same reference numerals are used as in the previous illustrations as much as possible. With regard to the fourth variant of the cutting element, the corresponding reference numerals are chosen to be a full three hundred higher than those used for the first variant embodiment. A detail discussion of FIG. 14 is therefore unnecessary.

FIGS. 15A and 15B, further show that the circular protrusion of the cutting element 400 is formed by a smoothly finished knob 412 received in the opening 19 of the holder 1. This knob 421 can be operated with the thumb to turn up a fresh cutting edge between the teeth 411, 413 and 415. If necessary, the knob 421 may also be provided with a serration to increase the grip during turning. Such a control knob 421A, provided with a radial rib, can be seen in FIG. 16. This knob is not rotationally connected with the hub 525 of the blade holder 503 (see FIG. 13). Turning the knob 421 or 421A will therefore result in turning the cutting edge 507.

Figure 17:
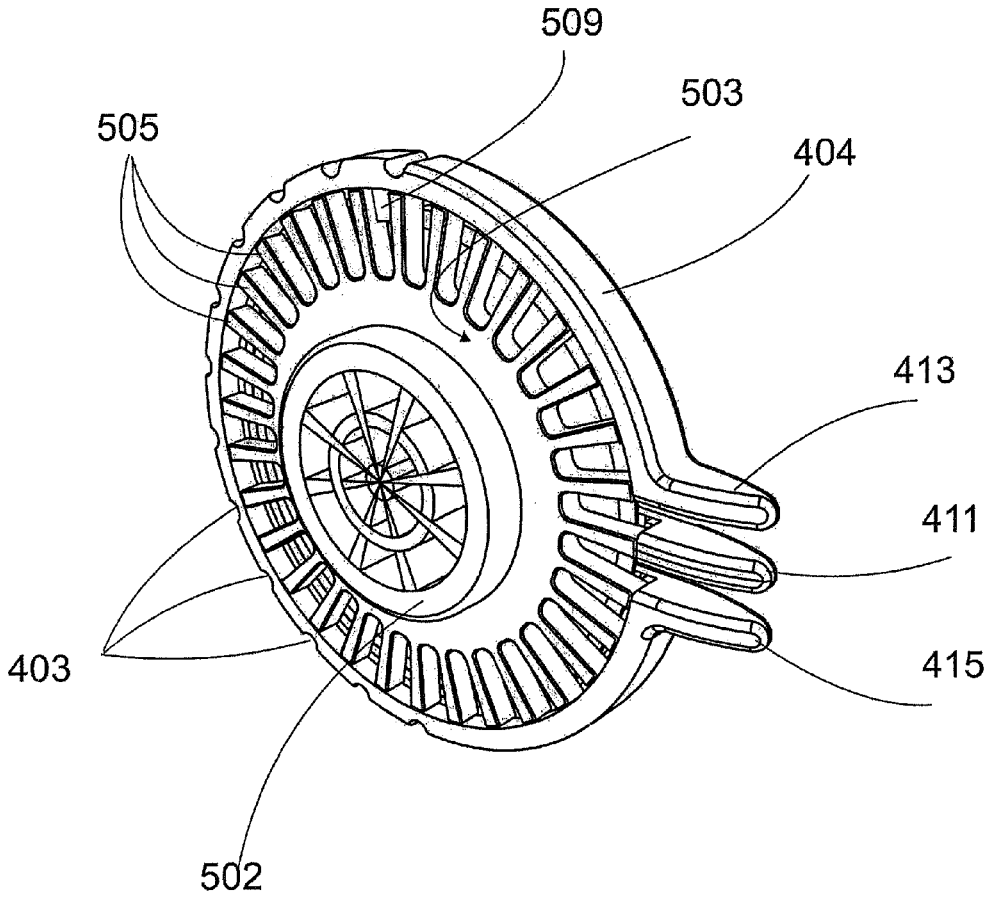
FIG. 17 shows the opposite side of the cutting element of FIG. 16, in accordance with FIG. 8.
Figure 18:
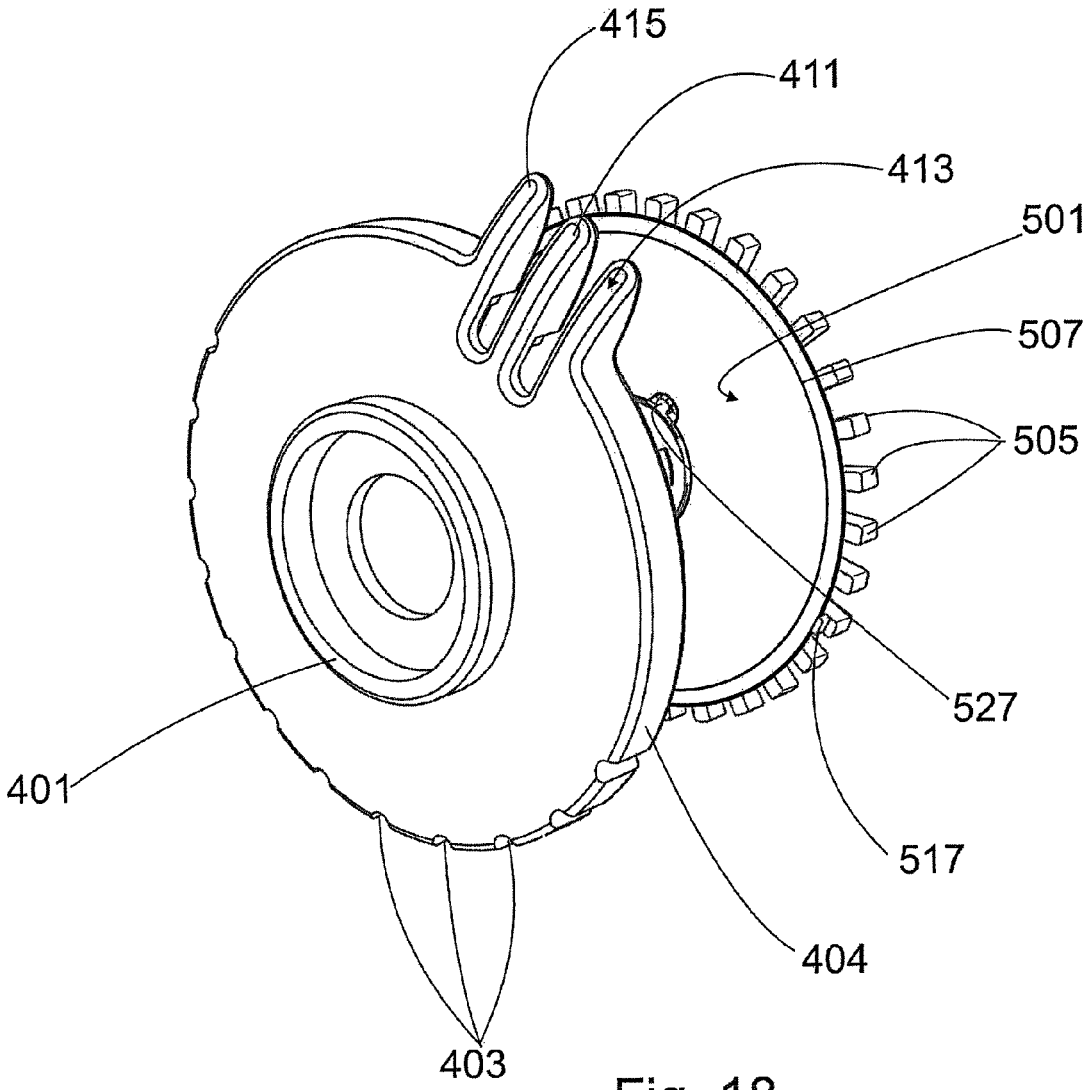
FIG. 18 shows an exploded view of the cutting element according to the fourth embodiment, in accordance with FIG. 12.

FIGS. 17 and 18 show how the blade holder 502 cooperates with a first part 404 of the cutting element 400 according to the fourth variant embodiment. A cam 509 is again provided on the first part of the cutting element 400 (FIG. 17) and a finger 517 is again present on one of the radial flexible arms 505 of the blade holder 503 (FIG. 18). For a further description of the cooperation between the cam 509, the radial arms 505 and the finger 517 with the first part 404, reference is made to the completely identical construction of the third variant of the cutting element 300, as described with respect to FIGS. 8-13.

With regard to the third and fourth variant embodiments of the cutting element, it can be noted that the number of flexible radial arms 505 of the blade holder 503 determines the smallest measure of adjustment and length of the cutting edge. In the third embodiment of the cutting element 300 according to FIGS. 7-12, this corresponds with the smallest distance between the scissor jaw halves 311 and 312. In the example shown, the blade holder has 32 radial arms 505. With respect to the cam 509, this results in a total of 31 individual cutting edge positions. In the example of the fourth embodiment of cutting element 400 according to FIGS. 14-18, each time, two cutting edge parts are simultaneously in use and, with a same number of 32 radial arms 505, each time, two arms will need to be turned beyond the cam 509 to refresh all cutting edge parts used. Of course, it can be chosen to use a blade holder with fewer radial arms, for instance 16, in this application.

Further, it should be noted that cutting tools according to the third and fourth embodiment are also very well applicable in a hairdresser's tool in which the cutting elements are not exchangeable and are each designed as an integral component of their holders. One then loses the advantage of the universal exchangeability, but nevertheless maintains the advantage of the refreshable cutting edge.

For all designs described here it holds that, with the using up of the cutting edges of the blades, the cutting element can be replaced by a new one while the old element can be offered for recycling.

It is assumed that the operation and construction of the present invention will be clear from the above description. The invention is not limited to any embodiment described herein and, within the ability of the skilled person, modifications are possible which are understood be within the scope of the protection. Also, all kinematic inversions are understood to be within the protective scope of the present invention. Expressions, such as "consisting of", when used in this description or the appended claims, should not be understood in an exclusive meaning, but rather in an inclusive meaning. Expressions like: "means for . . . " should be read as: "component formed for . . . " or "element constructed to . . . " and should be understood to comprise all equivalents for the described constructions as well. The use of expressions like: "critical", "advantageous", "desired", etc. is not intended to limit the invention. In addition, properties not specifically or expressly described or required in the construction can be comprised according to the present invention without deviating from the protective scope.

The invention claimed is:

1. A hairdresser's tool comprising:

a holder with a handle; and at least one exchangeable cutting element which is detachably coupled to the holder, wherein the holder includes a first coupling means and the at least one exchangeable cutting element includes a second coupling means, the first and the second coupling means being arranged to hold the cutting element in at least two different positions with respect to the holder, wherein the first and second coupling means are designed as angularly settable coupling means for adjusting an angular position of the at least one exchangeable cutting element with respect to the holder, wherein the holder comprises a pivoting element which can be pivoted outwards from the handle, wherein the first coupling means is provided on a free end of the pivoting element, wherein when the pivoting element is pivoted inwardly, from an outwardly pivoted position, with respect to the handle, the first coupling means is arranged to couple the at least one exchangeable cutting element to the holder, wherein when the pivoting element is pivoted outwardly, from an inwardly pivoted position, with respect to the handle, the first coupling means is arranged to allow the at least one exchangeable cutting element to be exchanged, wherein the first coupling means comprises a first arm part and a second arm part, and wherein the first arm part and the second arm part of the first coupling means are adapted to be pivoted outwardly and inwardly with respect to a plane of the handle.

2. The hairdresser's tool according to claim 1, wherein the cutting element is received between the first arm part and the second arm part.

3. The hairdresser's tool according to claim 1, wherein the first and second arm parts are pivotally provided on the handle of the holder and are then pivotable about a first axis.

4. The hairdresser's tool according to claim 3, wherein the second arm part is pivotable with respect to the first arm part about a second axis which is positioned substantially at a right angle to the first axis.

5. The hairdresser's tool according to claim 1, wherein the at least one exchangeable cutting element comprises at least a first protrusion and wherein at least one of the first and second arm parts comprises a recess for receiving the at least first protrusion.

6. The hairdresser's tool according to claim 5, wherein the recess for receiving the at least first protrusion is formed by a first opening in the first arm part with a contour adapted to the at least first protrusion.

7. The hairdresser's tool according to claim 6, wherein the second arm part comprises a second opening for receiving a second protrusion provided on the cutting element, wherein the contours of the second opening and the second protrusion likewise correspond with each other.

8. The hairdresser's tool according to claim 7, wherein at least one of the first and the second openings has a circular contour.

9. The hairdresser's tool according to claim 7, wherein both the first and the second opening have a circular contour.

10. The hairdresser's tool according to claim 9, wherein the second opening is coaxial with the first opening, and wherein the cutting element has a circumferential part substantially concentric therewith with alternating elevations and depressions provided at regular distances from one another, arranged to cooperate with at least one singularly present corresponding shape element on the holder.

11. The hairdresser's tool according to claim 10, wherein the alternating elevations and depressions provided at regular distances from one another are formed by means of at least three notches positioned along the circumferential part of the cutting element and the at least singularly present shape element on the holder is formed by a cam.

12. A cutting element adapted for incorporation into a hairdresser's tool, the tool comprising:

a holder with a handle; and at least one exchangeable cutting element which is detachably coupled to the holder, wherein the holder includes a first coupling means and the at least one exchangeable cutting element includes a second coupling means, the first and the second coupling means being arranged to hold the cutting element in at least two different positions with respect to the holder, wherein the first and second coupling means are designed as angularly settable coupling means for adjusting an angular position of the at least one exchangeable cutting element with respect to the holder, wherein the holder comprises a pivoting element which can be pivoted outwards from the handle, wherein the first coupling means is provided on a free end of the pivoting element, wherein when the pivoting element is pivoted inwardly, from an outwardly pivoted position, with respect to the handle, the first coupling means is arranged to couple the at least one exchangeable cutting element to the holder, and wherein when the pivoting element is pivoted outwardly, from an inwardly pivoted position, with respect to the handle, the first coupling means is arranged to allow the at least one exchangeable cutting element to be exchanged, wherein the first coupling means comprises a first arm part and a second arm part, and wherein the first arm part and the second arm part of the first coupling means are adapted to be pivoted outwardly and inwardly with respect to a plane of the handle.

13. The cutting element according to claim 12 wherein a cutting edge is provided which has a part of a cutting blade extending between at least two teeth.

14. A hairdresser's tool comprising:

a holder with handle; and at least one exchangeable cutting element which is detachably coupled to the holder, wherein the holder includes a first coupling means and the at least one exchangeable cutting element includes a second coupling means, the first and the second coupling means being arranged to hold the cutting element in at least two different positions with respect to the holder, wherein the first and second coupling means are designed as angularly settable coupling means for adjusting an angular position of the at least one exchangeable cutting element with respect to the holder, wherein the holder comprises a pivoting element which can be pivoted outwards from the handle, wherein the first coupling means is provided on a free end of the pivoting element, wherein when the pivoting element is pivoted inwardly, from an outwardly pivoted position, with respect to the handle, the first coupling means is arranged to couple the at least one exchangeable cutting element to the holder, wherein when the pivoting element is pivoted outwardly, from an inwardly pivoted position, with respect to the handle, the first coupling means is arranged to allow the at least one exchangeable cutting element to be exchanged, wherein the first coupling means comprises a first arm part and a second arm part, between which the cutting element is received, wherein the first and second arm parts are pivotally provided on the handle of the holder and are then pivotable about a first axis, and wherein the second arm part is pivotable with respect to the first arm part about a second axis which is positioned substantially at a right angle to the first axis.

15. A hairdresser's tool comprising:

a holder with handle; and at least one exchangeable cutting element which is detachably coupled to the holder, wherein the holder includes a first coupling means and the at least one exchangeable cutting element includes a second coupling means, the first and the second coupling means being arranged to hold the cutting element in at least two different positions with respect to the holder, wherein the first and second coupling means are designed as angularly settable coupling means for adjusting an angular position of the at least one exchangeable cutting element with respect to the holder, wherein the holder comprises a pivoting element which can be pivoted outwards from the handle, wherein the first coupling means is provided on a free end of the pivoting element, wherein when the pivoting element is pivoted inwardly, from an outwardly pivoted position, with respect to the handle, the first coupling means is arranged to couple the at least one exchangeable cutting element to the holder, wherein when the pivoting element is pivoted outwardly, from an inwardly pivoted position, with respect to the handle, the first coupling means is arranged to allow the at least one exchangeable cutting element to be exchanged, wherein the first coupling means comprises a first arm part and a second arm part, between which the cutting element is received, wherein the at least one exchangeable cutting element comprises at least a first protrusion and wherein at least one of the first and second arm parts comprises a recess for receiving the at least first protrusion, and wherein the recess for receiving the at least first protrusion is formed by a first opening in the first arm part with a contour adapted to the at least first protrusion.

16. The hairdresser's tool according to claim 15, wherein the second arm part comprises a second opening for receiving a second protrusion provided on the cutting element, wherein the contours of the second opening and the second protrusion likewise correspond with each other.

17. The hairdresser's tool according to claim 16, wherein at least one of the first and the second openings has a circular contour.

18. The hairdresser's tool according to claim 16, wherein both the first and the second opening have a circular contour.

19. The hairdresser's tool according to claim 18, wherein the second opening is coaxial with the first opening, and wherein the cutting element has a circumferential part substantially concentric therewith with alternating elevations and depressions provided at regular distances from one another, arranged to cooperate with at least one singularly present corresponding shape element on the holder.

20. The hairdresser's tool according to claim 19, wherein the alternating elevations and depressions provided at regular distances from one another are formed by means of at least three notches positioned along the circumferential part of the cutting element and the at least singularly present shape element on the holder is formed by a cam.

21. The cutting element of claim 12 wherein the cutting element is adapted to be received between the first arm part and the second arm part of the hairdresser's tool.

* * * * *